252-99 AU 166 EX
745/83 Sr 4,391,726

United States Patent [19]

Koster

[11] 4,391,726

[45] Jul. 5, 1983

[54] DETERGENT COMPOSITION CONTAINING LOW LEVELS OF AMINE OXIDES

[75] Inventor: Robertus J. C. Koster, Grimbergen, Belgium

[73] Assignee: The Procter & Gamble Company, Cincinnati, Ohio

[21] Appl. No.: 274,126

[22] Filed: Jun. 16, 1981

[30] Foreign Application Priority Data

Nov. 28, 1980 [GB] United Kingdom ..... 8038306

[51] Int. Cl.[3] ..... C11D 7/18

[52] U.S. Cl. ..... 252/99; 252/102; 252/527; 252/528; 252/546; 252/547

[58] Field of Search ..... 252/99, 102, 528, 527, 252/547, 546

[56] References Cited

U.S. PATENT DOCUMENTS

| | | | |
|---|---|---|---|
| 3,202,714 | 8/1965 | Zimmerer et al. | 564/297 |
| 3,234,139 | 2/1966 | Drew et al. | 252/528 |
| 3,317,430 | 5/1967 | Priestley et al. | 252/547 |
| 3,531,526 | 9/1970 | Logan | 564/297 |
| 3,697,452 | 10/1972 | Olson et al. | 252/547 |
| 3,808,311 | 4/1974 | Olson et al. | 252/547 |
| 3,843,563 | 10/1974 | Davies et al. | 252/547 |
| 4,065,409 | 12/1977 | Flanagan | 252/547 |
| 4,133,779 | 1/1979 | Hellyer et al. | 252/547 |

FOREIGN PATENT DOCUMENTS 1007343 10/1965 United Kingdom .

*Primary Examiner*—Sadie L. Childs

[57] ABSTRACT

Detergent compositions having enhanced soil release and cleaning properties include from 0.1%–1.5% amide oxide having at least one long chain group and may include peroxybleach and detergent builder, and provide an alkaline laundry pH.

8 Claims, No Drawings

DETERGENT COMPOSITION CONTAINING LOW LEVELS OF AMINE OXIDES

TECHNICAL FIELD

This invention relates to detergent compositions containing low levels of amine oxides. These amine oxides are substituted by at least one long chain alkyl or alkenyl group. Preferred amine oxides have at least two alkyl, especially methyl, or two alkylene oxide, especially ethylene oxide, groups attached to the nitrogen atom(s). These compositions produce an alkaline laundry liquor pH. These compositions exhibit a broad range of remarkable textile treatment benefits, particularly enhanced soil release and cleaning properties.

There is a standing desire to improve textile cleaning and confer further textile benefits through either the laundry treatment or via the subsequent use, vs. the laundry treatment, of an additive e.g. during the rinse.

U.S. Pat. No. 3,985,923, Basadur, issued Oct. 12, 1976, relates to the application of renewable soil release finish during the rinsing step from a dilute aqueous acidic solution. The release agent is a copolymer based on a dibasic carboxylic acid and a glycolic compound.

U.S. Pat. No. 3,962,152, Nicol, Hays, issued June 8, 1976 pertains to the laundry treatment deposition of renewable soil release finish to synthetic fabrics treated therewith. The soil release finish consists of ethylene terephthalate and polyethylene oxide terephthalate.

The performance benefits derived from the utilization of the like additives are premised on the deposition of a releasable coating onto the fiber from the laundry/rinsing step. The coating will be rinsed off during the next laundry cycle, inclusive of the total soil accumulated thereon, to thus provide a "non-alterated" degree of cleaning.

Mono- and polyamine oxides have found widespread application in detergent technology, mostly in a surfactant functionality. Representative of this known state of the art are the following references.

1. Dutch Patent Application No. 72-04495, Unilever N.V., relates to alkali metal carbonate built detergent compositions containing a binary surfactant combination, namely a nonionic surfactant and a mono amine oxide which are normally used in a ratio of 1:3 to 3:1. The total level of nonionic surfactant and amine oxide is in the range from 5–25%.

2. British Pat. No. 1,007,343, The Procter & Gamble Company, relates to surface-active diamine dioxides and compositions composed thereof. These diamine dioxides are used in conventional "surface-active" levels, i.e., at least 5% by weight of the finished detergent compositions.

3. U.S. Pat. No. 3,531,526, The Procter & Gamble Company, pertains to detergent diamine dioxides, prepared by oxidation of the corresponding diamines. These oxides are used in detergents in levels from 5–50%.

4. U.S. Pat. No. 4,133,779, The Procter & Gamble Company, relates to detergent compositions containing a semi-polar nonionic e.g. an amine oxide, in combination with an alkaline earth metal of an anionic detergent. These compositions exhibit a neutral to slightly alkaline pH. Exemplified levels of amine oxide in granular detergents range from 1–15%.

5. U.S. Pat. No. 3,202,714, The Procter & Gamble Company, pertains to oxy-containing tertiary amine oxide detergents and detergent compositions containing them. These oxides are used in granular and liquid detergents in levels frequently exceeding 10%.

The total prior art refers to the utilization of mostly monoamine oxides in a conventional detergent functionality. It is widely recognized that such amine oxides are good surfactants and indeed have been utilized in commercial detergent executions. However, the art is not suggestive of incidental textile benefits derivable from utilizing unexpectedly low levels of the very components in a non-surfactant functionality.

It is an object of the present invention to provide detergent compositions containing a surface-active agent and low levels of amine oxides; these compositions are capable of providing a broad range of textile treatment benefits, particularly enhanced soil release and cleaning properties.

SUMMARY OF THE INVENTION

The present invention comprises detergent compositions having enhanced soil release and cleaning properties containing:

(a) from 2–60% surfactant selected from the group consisting of anionic, nonionic, zwitterionic and ampholytic detergents and mixtures thereof; and (b) from 0.1%–1.5% of an amine oxide having the formula

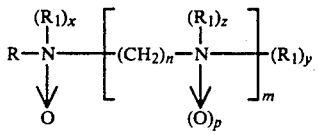

wherein R is an alkyl or alkenyl group having 10 to 22 carbon atoms, the $R_1$'s which are identical or different are selected from $C_{1-4}$ alkyl, ethylene oxide and propylene oxide, n is an integer from 1 to about 6, m is an integer from 0 to about 6, p is 0 or 1, x, y, and z are each 1 for alkyl substitutes and integers in the range from 1 to 10 for ethylene oxide or propylene oxide substituents such that the sum of (x+y+z) is not greater than 25, whereby a 1% aqueous solution of the composition has an alkaline pH (20° C.).

In a preferred embodiment, the compositions herein are granular compositions having an alkaline pH in the range from about 8.5–11 (1% aqueous solution, 20° C.). In another preferred embodiment, the compositions herein are homogeneous liquid compositions having also an alkaline pH in the range from about 7.5–10.5 (1% aqueous solution, 20° C.). Preferred granular compositions herein are built detergent compositions wherein the builder system is comprised of a water-soluble detergent builder or a water-insoluble aluminosilicate detergent builder or a mixture thereof.

DETAILED DESCRIPTION OF THE INVENTION

The detergent compositions of the present invention are defined in three essential parameters:

(a) a surface-active agent;

(b) an amine oxide; and (c) have an alkaline pH in 1% aqueous solution at 20° C.

Optional ingredients can be added to provide various performance and aesthetic benefits. The granular detergent executions of this invention frequently comprise a peroxybleach ingredient, if desired a peractivated system, in the usual levels, i.e., in the range from about 3% to about 50% by weight, and a builder or co-builder system as defined in more detail hereinafter.

Unless indicated to the contrary, the "percent" indications hereinafter stand for "percent by weight".

The detergent compositions in accordance with this invention can be in any conventional physical state inclusive of liquid pasty and solid executions.

SURFACE-ACTIVE AGENT

The detergent compositions herein comprise, as a first essential component, a surface-active agent selected from the group consisting of anionic, nonionic, zwitterionic and ampholytic detergents and mixtures thereof.

The surface-active agents normally represent from 2% to 60% of the detergent composition.

The preferred granular detergents herein usually contain from about 2% to about 25%, preferably from about 5% to about 20% of organic surface-active agents. Liquid executions of this invention frequently contain surface-active agents in a level from about 5% to about 50%, preferably from 15% to 40%.

Suitable organic surface-active agents herein can be represented by active ingredients which are known to meet the requirements for use in and/or have already been used in detergent compositions. Exemplifying species for use herein can be selected from the group of anionic, nonionic, ampholytic, zwitterionic, surfactants and mixtures thereof.

Examples of suitable nonionic surfactants include:

(1) The polyethylene oxide condensates of alkyl phenols. These compounds include the condensation products of alkyl phenols having an alkyl group containing from about 6 to 12 carbons atoms in either a straight chain or branched chain configuration, with ethylene oxide, the said ethylene oxide being present in amounts equal to 5 to 25 moles of ethylene oxide per mole of alkyl phenol.

(2) The condensation products of aliphatic alcohols with ethylene oxide. The alkyl chain of the aliphatic alcohol may either be straight or branched and generally contains from about 8 to about 22 carbon atoms. Examples of such ethoxylated alcohols include the condensation product of about 6 moles of ethylene oxide with 1 mole of tridecanol, myristyl alcohol condensed with about 10 moles of ethylene oxide per mole of myristyl alcohol, the condensation product of ethylene oxide with coconut fatty alcohol wherein the coconut alcohol is a mixture of fatty alcohols with alkyl chains varying from 10 to 14 carbon atoms and wherein the condensate contains about 6 moles of ethylene oxide per mole of alcohol, and the condensation product of about 9 moles of ethylene oxide with the above-described coconut alcohol.

(3) The condensation products of ethylene oxide with the product resulting from the reaction of propylene oxide and ethylene diamine. The condensation product frequently contains from about 40% to about 80% by weight of polyoxyethylene and has a molecular weight of from about 5,000 to about 11,000.

Examples of suitable ampholytic synthetic detergents are sodium 3-(dodecyl-amino)-propionate, and sodium 3-(dodecylamino)propane-1-sulfonate.

Zwitterionic surfactants for use herein include 3-(N,N-dimethyl-N-hexadecylammonio)-2-hydroxypropane-1-sulfonate, 3-(N,N-dimethyl-N-alkylammonio)-2-hydroxypropane-1-sulfonate, the alkyl group being derived from tallow fatty alcohol; 3-(N,N-dimethyl-N-hexadecylammonio)propane-1-sulfonate; 3-(N,N-dimethyl-N-tetradecylammonio)propane-1-sulfonate; and 3-(N—N-dimethyldodecylammonio)-2-hydroxypropane-1-sulfonate.

Suitable anionic detergents include ordinary alkali metal soaps of higher fatty acids containing from about eight to about 24 carbon atoms and preferably from about 10 to about 20 carbon atoms.

Alkyl sulfonated or sulfated surfactants inclusive of alkyl benzene sulfonates, in which the alkyl group contains from about 9 to about 20 carbon atoms in straight-chain or branched-chain configuration, e.g., those of the type described in U.S. Pat. Nos. 2,220,099 and 2,477,383 (especially valuable are linear straight chain alkyl benzene sulfonates in which the average of the alkyl groups is about 11.8 carbon atoms and commonly abbreviated as $C_{11.8}$ LAS); sodium alkyl glyceryl ether sulfonates, especially those ethers of higher alcohols derived from tallow and coconut oil; sodium coconut oil fatty acid monoglyceride sulfonates and sulfates also represent a class of very useful anionic surface-active agents.

Useful in this invention are also salts of 2-acyloxyalkane-1-sulfonic acids.

Typical examples of the 2-acyloxy-alkanesulfonates are described in Belgium Pat. No. 650,323 issued July 9, 1963, U.S. Pat. No. 2,094,451 issued Sept. 28, 1937 to Guenther et al., and U.S. Pat. No. 2,086,215 issued July 6, 1937 to DeGroote; these references are hereby incorporated by reference.

$\beta$-alkoxy alkane sulfonates can also be used. Specific examples of $\beta$-alkyloxy alkane sulfonates having low hardness (calcium ion) sensitivity useful herein to provide superior cleaning levels under household washing conditions include: potassium-$\beta$-methoxydecanesulfonate, sodium 2-methoxytridecanesulfonate, potassium 2-ethoxytetradecylsulfonate, and sodium 2-isopropoxyhexadecylsulfonate.

Paraffin sulfonates containing a straight or branched chain, saturated aliphatic hydrocarbon radical having from 8 to 24, preferably 12 to 18, carbon atoms can also be used.

Other synthetic anionic detergents useful herein are alkyl ether sulfates. These materials have the formula $RO(C_2H_4O)_xSO_3M$ wherein R is alkyl or alkenyl of about 10 to about 20 carbon atoms, x is 1 to 30, and M is a water-soluble cation.

Suitable examples of alkyl ether sulfates are those comprising a mixture of individual compounds, said mixture having an average alkyl chain length of from about 12 to about 16 carbon atoms and an average degree of ethoxylation of from about 1 to 4 moles of ethylene oxide. Such a mixture also comprises from about 0 to 20% by weight $C_{12-13}$ compounds; from 60 to 100% by weight of $C_{14-15-16}$ compounds; from 0 to 20% by weight of $C_{17-18-19}$ compounds; from about 3 to 30% by weight of compounds having a degree of ethoxylation of 0; from about 45 to 90% by weight of compounds having a degree of ethoxylation of from 1 to 4; from about 10 to 25% by weight of compounds having a degree of ethoxylation of from 4 to 8; and from about 0.1 to 15% by weight of compounds having a degree of ethoxylation greater than 8.

$\alpha$-Olefin sulfonate mixtures as described in U.S. Pat. No. 3,332,880, issued July 25, 1967, incorporated herein by reference, can also be used.

THE AMINE OXIDE

A second essential component in the compositions herein is represented by an amine oxide having the formula

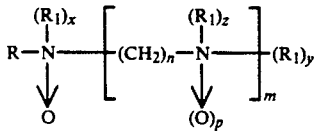

wherein R is an alkyl or alkenylgroup having 10 to 22 carbon atoms, the $R_1$'s which are identical or different are selected from $C_{1-4}$ alkyl, ethylene oxide and propylene oxide, n is an integer from 1 to about 6, m is an integer from 0 to about 6, p is 0 or 1, x, y, and z are each 1 for alkylsubstituents, and integers in the range from 1 to 10 for ethylene oxide or propylene oxide substituents such that the sum of (x+y+z) is not greater than 25.

This amine oxide component is used in a level from 0.1% to 1.5%, preferably from 0.25% to 0.75%. Utilizing less than the minimum levels will not provide anymore the inventive benefits, whereas levels above the specified definition will not yield anymore performance advantages but rather unexpectedly causes noticeable cleaning performance negatives, particularly whiteness deficiencies.

Suitable species of the amine oxide component for use herein correspond to the general formula above wherein the individual substituents can be varied as follows:

R: tallow $C_{16-18}$ alkyl; coconut $C_{12-14}$ alkyl; lauryl; palmityl; stearyl; oleyl.
$R_1$: ethylene oxide; propylene oxide; methyl; ethyl.
n: 2, 3, 4.
m: 0, 1, or 2.
x,y, and z are each 1, 2, 3 or 4 and their sum is from 2 to 18.

Preferred amine oxides for use herein are defined by the following substituents:

R: hydrogenated tallow $C_{16-18}$ alkyl; coconut $C_{12}$–$C_{14}$ alkyl.
$R_1$: ethylene oxide; methyl.
m: 0 or 1;
n: 3 (assuming m is different from 0).
x, y, z are each at least 1 and their sum is in the range from 2 to 12, for example 2, 3,7 and 12.

One particularly preferred class of amine oxide species is represented by mono-amine oxides having the following substituents.

m: 0.
$R_1$: methyl; ethyl; ethylene oxide.
R: coconut $C_{12}$–$C_{14}$ alkyl.
x and y are both 1.

A specific example of this preferred class of mono-amine oxides is: N—$C_{12}$—$C_{14}$ coconut alkyl-N,N-dimethyl amine oxide.

Another particularly preferred class of amine oxide species is represented by bis-amine oxides having the following substituents.

m: 1
R: tallow $C_{16}$–$C_{18}$ alkyl; palmityl; oleyl; stearyl.
$R_1$: ethylene oxide.
n: 2 or 3.
x, y, and z are each at least 1, and their sum is from 3 to 12. A specific example of this preferred class of bis-amine oxides is: N-hydrogenated $C_{16}$–$C_{18}$ tallow alkyl-N,N',N'-tri-(2-hydroxyethyl)-propylene-1,3-diamine oxide.

ALKALINE SOLUTION

The compositions herein shall yield upon dissolution in water an alkaline laundry liquor. Preferably, a 1% aqueous solution of granular detergent compositions shall have an alkaline pH in the range from about 8.5 to about 11, measured at 20° C. A 1% aqueous solution of liquid detergent compositions frequently has a pH in the range from 7.5–10.5 (20° C.). The pH can be adjusted by known means inclusive of alkaline buffer substances such as alkali hydroxides, ammonium hydroxide, amines and substituted amines, such as mono-, di- and triethanolamines; alkaline builder substances such as alkali metal carbonates, alkalimetal phosphates and polyphosphates, citric acid and alkalimetal silicates. The proper choice of suitable pH adjusting agents shall of course take into account the physical state—liquid, pasty, solid—of the composition and the relative compatibility of the additional ingredients of a particular composition. Such ingredient optimization and selection are well-known routine measures, however.

OPTIONAL INGREDIENTS

As is well-known, detergent compositions vary in relation to the physical state of the composition, the intended usage and the local textile treatment needs inclusive of laundering habits. Solid, granular detergent compostions frequently contain a peroxybleach compound in an amount from about 3% to about 50%, preferably from about 5% to about 35%. Suitable peroxybleach compounds are all those which are known to be adapted for use in or have already been used in detergent technology. Examples of such peroxybleaches include the water-soluble alkali salts of perborate mono-hydrate, perborate tetrahydrate, persulfates, persilicates, perphosphates, and percarbonates. Organic oxygen-bleach activators can also advantageously be used in oxygen-bleach containing detergent executions of this invention. Examples of such activators include phthalic anhydride, tetra-acetyl ethylene diamine, tetra-acetyl methylene diamine and tetra-acetyl glycouril. Such activators are frequently used in levels from about 0.2% to 15%, preferably from 1% to 4%. The weight ratios of the peroxybleach compound to the activator is frequently in the range from about 10:1 to 2:1.

The detergent compositions of this invention further frequently contain as an optional ingredient, a detergent builder in a level from about 1% to about 50%. The non-solid detergent embodiments frequently contain builder ingredients in levels up to 15%. The solid detergents contain a detergent builder or a detergent builder system in a level which is preferably in the range from about 10% to about 45%. The builder component can be represented by all known water-soluble and water-insoluble detergent builder ingredients.

Non-limiting examples of suitable water-soluble, inorganic alkaline detergency builder salts include the alkali metal carbonates, borates, phosphates, polyphosphates, tripolyphosphates, bicarbonates, silicates, and sulfates. Specific examples of such salts include the sodium and potassium tetraborates, bicarbonates, carbonates, tripolyphosphates, pyrophosphates, and hexametaphosphates.

Examples of suitable organic alkaline detergency builder salts are: (1) water-soluble amino polyacetates, e.g. sodium and potassium ethylene diamine tetra-acetates, nitrilotriacetates, and N-(2-hydroxyethyl)nitrilodiacetates; (2) water-soluble salts of phytic acid, e.g. sodium and potassium phytates; (3) water-soluble polyphosphonates, including sodium, potassium and lithium salts of ethane-1-hydroxy-1,1-diphosphonic acid; sodium, potassium, and lithium salts of methylenediphosphonic acid and the like. Additional organic builder salts useful herein include the polycarboxylate materials described in U.S. Pat. No. 2,264,103, including the water-soluble alkali metal salts of mellitic acid. The water-soluble salts of polycarboxylate polymers and copolymers such as are described in U.S. Pat. No. 3,308,067, incorporated herein by reference, are also suitable herein. Citric acid detergent builders can advantageously be used in liquid detergents.

It is to be understood that while the alkali metal salts of the foregoing inorganic and organic polyvalent anionic builder salts are preferred for use herein from an economic standpoint, the ammonium, alkanolammonium (e.g. triethanolammonium, diethanolammonium and monoethanolammonium) and other water-soluble salts of any of the foregoing builder anions can be used.

Mixtures of organic and/or inorganic builders can be used herein. One such mixture of builders is disclosed in Canadian Pat. No. 755,038, e.g., a ternary mixture of sodium tripolyphosphate, trisodium nitrilotriacetate, and trisodium ethane-1-hydroxy-1,1-diphosphonate.

Another type of detergency builder material useful in the present invention comprises a water-soluble material capable of forming a water-insoluble reaction product with water hardness cations, preferably in combination with a crystallization seed which is capable of providing growth sites for said reaction product. Specific examples of materials capable of forming the water-insoluble reaction product include the water-soluble salts of carbonates, bicarbonates, sesquicarbonates, silicates, aluminates and oxalates. The alkali metal, especially sodium, salts of the foregoing materials are preferred for convenience and economy. Preferred crystallization seed materials are calcium carbonate, calcium oxide and calcium hydroxide. Such "seeded builder" compositions are fully disclosed in British Patent Specification No. 1,424,406, incorporated herein by reference.

Non-seeded precipitating builder systems employing pyrophosphates or mixtures thereof with orthophosphates are also useful herein. Precipitating pyrophosphate and orthopyrophosphate builder systems are disclosed in German Patent Applications OLS Nos. 25 42 704 and 26 05 052 published Apr. 15 and Aug. 16, 1976, respectively, which are specifically incorporated herein by reference.

Suitable examples of water-insoluble detergent builders are selected from the group consisting of zeolites A, X, or P(B), or mixtures thereof, having a particle size diameter of from about 0.01 micron to about 25 microns and containing at least 10% water of hydration, and amorphous hydrate aluminosilicate material of the empirical formula: $M_z(zAlO_2.ySiO_2)$ wherein M is sodium, potassium ammonium, z is from about 0.5 to about 2, y is 1, said material having a particle size diameter of less than about 100 microns, a magnesium ion exchange capacity of at least about 50 milligrams equivalents of $CaCO_3$ hardness per gram of anhydrous aluminosilicate, and a $Mg^{++}$ exchange rate of at least about 1 grain/gallon/minute/gram/gallon, and mixtures thereof.

The preferred synthetic crystalline aluminosilicate materials for use herein commonly known as Zeolites A, X, and P(B) should contain at least 10% water of hydration and should have a particle size diameter of from about 0.5 micron to about 30 microns, more preferably from about 0.5 micron to about 10 microns. Aluminosilicate materials are more fully described in U.S. Pat. No. 4,096,081, Phenicie et al., issued June 20, 1978, and German Pat. No. 27 04 003, Ohren, published on Aug. 18, 1977, the disclosures of which are incorporated herein by reference. The amorphous aluminosilicate materials suitable for use herein are fully described in U.S. Pat. No. 4,180,485, Llenado, published Dec. 25, 1979, incorporated herein by reference.

The water-insoluble detergent builders are frequently and preferably utilized in the granular compositions herein in conjunction with a water-soluble detergent cobuilder ingredient in a weight ratio of aluminosilicate:water-soluble detergent cobuilder of from 4:1 to 1:4. Suitable examples of preferred water-soluble cobuilder ingredients are represented by the water-soluble salts of nitrilotriacetic acid, polyphosphates e.g. tripolyphosphates, and citrates. The cations of these cobuilders can e.g. be represented by alkalimetal ions, sodium, potassium, lithium, and by organic ions such as amines, substituted amines (alkanolamines) and ammonium ions.

In addition to the components described hereinbefore, the compositions of this invention can comprise a series of supplementary components to perfect and complement the benefits derived from the compositions herein. These additional components include brighteners, dyes, perfumes, bactericides, processing aids, antioxidants, corrosion inhibitors, enzymes suds regulants and so on.

It may be desirable to add a copolymer of a (1) vinyl compound having the general formula RCH=CHR wherein one R represents a hydrogen atom and the other R represents an alkyl radical containing from one to about 4 carbon atoms; and (2) maleic anhydride. The copolymeric vinyl ingredient is normally used in an amount from about 0.1% to about 6%, preferably from 0.25% to 4%. Specific examples of these copolymeric ingredients include a water-soluble acid, an alkali-metal salt of that acid, an ester, or a $C_{1-2}$alkyl- or alkylolamide of a maleic anhydride-vinyl $C_{1-4}$ alkyl ether copolymer. The specific viscosity of, for example, the maleic anhydride-vinyl $C_{1-4}$ alkyl ether, preferably methylether, copolymer for use herein normally varies between 0.1 and 6, most preferably between 0.2 and 5.0. The (molecular) monomer ratio (maleic:vinylalkylether) is preferably in the range from 2:1 to 1:2. The specific viscosity is defined by measuring the viscosity of the solution of 1 g of the anhydride copolymer in 100 ml methylethylketone at 25° C. in a series 100 CANNON-FENSKE viscosity meter. The copolymeric component can serve as slurry processing aid to thus provide a detergent product having improved physical properties including flowability.

Another optional ingredient is a mixture of alkoxylated mono- and diesters of phosphoric acid. This mixture which is normally used in an amount from 0.5% to 20% by reference to the sum of the surface-active agents, is particularly useful in detergent compositions containing, in part or solely, nonionic surface-active agents. These phosphoric esters are preferably represented by alkoxylated fatty alcohols having from 10 to 22 carbon atoms with 2 to 15 moles ethylene oxide or propylene oxide. The weight ratio of monophosphoric esters to diphosphoric esters is usually in the range from 6:1 to 3:1, preferably 4:1.

It may be desirable, especially if nonionic surfactants are incorporated by slurrying and subsequent spray-drying, to add to the crutcher from 0.01% to 10%, expressed by reference to the nonionic surfactant of, an anti-oxidant. Suitable examples of anti-oxidant materials are disclosed in German Patent Application DAS No. 16 17 209. A preferred anti-oxidant material is 4,4'-thiobis(6-tert-butyl-m-cresol).

The detergent compositions can additionally contain an enzymatic ingredient. Proteases, amylases and lipases can be added in an amount from 0.001% to about 5% to augment and aid in the cleaning activity of the detergent compositions herein. Preferred proteolytic enzymes are disclosed in Belgian Pat. No. 775.854, to EYMERY et al., granted May 26, 1972.

The detergent compositions of this invention frequently comprise a suds regulant in a level of 0.01%–10%.

Suitable suds regulants are well-known in detergent technology and most of these can easily be used in combination with the claimed technology.

Conventional detergent suds regulants which can be used include saturated fatty acids especially those having 16 to 24 carbon atoms in the alkylchain, nonionic suds regulants and mixtures thereof. Another class of well-known suds regulants are silicones, preferably silanated silicones in admixture with microcrystalline waxes. Mixtures of low levels of silicones (0.01–0.2%) and/or fatty acids (0.2–2%) are known to be suitable for use in the liquid executions of this invention.

Preferred suds regulants containing a separately processed detergent additive on basis of a water-insoluble liquid hydrocarbon, an adjunct material preferable a solid hydrocarbon, and a hydrophobic silica are described in U.S. Pat. No. 4,192,761, Peltre and Lafleur, issued Mar. 11, 1980, incorporated herein by reference. These liquid hydrocarbon-containing regulants are preferably used in granular executions.

The following examples illustrate the invention and facilitate its understanding.

EXAMPLE I

A detergent composition was prepared having the following formulation.

| INGREDIENTS | Composition A | Example (% by weight) I |
|---|---|---|
| Linear dodecylbenzene sulfonate sodium salt | 5.6 | 5.6 |
| Tallow alcohol sulfate sodium salt | 2.4 | 2.4 |
| Sodium tripolyphosphate | 24.0 | 24.0 |
| Sodium silicate solids ($SiO_2$:$Na_2O$ = 1.6) | 6.0 | 6.0 |
| Carboxymethylcellulose | 1.0 | 1.0 |
| Copolymer of maleic anhydride and methyl vinyl ether | 1.0 | 1.0 |
| Sodium sulfate | 18.2 | 17.85 |
| Moisture | 7.0 | 7.0 |
| perborate tetrahydrate | 32.0 | 32.0 |
| enzyme | 0.3 | 0.3 |
| minors inclusive of perfume | 2.5 | 2.5 |
| suds regulant particles having the composition of Example I of U.S. Pat. No. 4,192,761 | 0.3 | 0.3 |

A series of spray-drying sensitive ingredients were added to the above base-powder by dry-mixing, namely:

0.35% of N-hydrogenated tallow-N,N',N'-tri-(2-hydroxyethyl)-propylene-1,3-diamine-N,N'-dioxide was sprayed onto the mixture of the base-powder and the spray-drying sensitive ingredients.

The detergent compositions were used for comparative laundry tests in a Miele W 421 washing machine.

Terry, undershirt and muslin cotton tracers were used to measure the comparative whiteness maintenance performance after 4 cumulative cycles.

Testing parameters were: 90° C. heat-up cycle; prewash step and main-wash step using a product concentration of 0.9% in city water with an average water hardness of about 3 mmoles/l; ratio Ca/Mg=5:1; laundering treatment in presence of 3 kg soiled clothes.

After having been subjected to the above washing treatment (4 cumulative cycles) the dried whiteness maintenance tracers were visually graded by two expert judges thereby using a 0–4 scale whereby:

0=see no difference between the swatches
1=believe there is a difference between the swatches
2=there is a difference between the swatches
3=am sure there is a difference between the swatches
4=very important difference between the swatches.

The whiteness maintenance readings were pooled and averaged on 4 replicates with the following results. The swatches treated with composition A were used for reference purposes:

| Tracer | Example I |
|---|---|
| Terry | +1.3 |
| Undershirt | +1.0 |
| Muslin | +1.0 |

+means that example I is preferred over composition A.

These testing results confirm the consistent superiority of example I in accordance with this invention versus prior art composition A.

Substantially identical results are obtained from the compositions of Example I wherein the tallow-diaminedioxide is substituted by a an equivalent level of: N—$C_{12-14}$-alkyl-N,N',N'-tri-(2-hydroxyethyl)-propylene-1,3-diamine-N,N'-dioxide; N-palmityl-N,N',N'-hepta-(2-hydroxyethyl)-ethylene-1,2-diamine-N,N'-dioxide; N—$C_{16-18}$-tallowalkyl-N,N-dimethyl-N-amine oxide; N—$C_{12-14}$-coconut alkyl-N,N-di-(2-hydroxyethyl)-N-amine oxide; or N—$C_{16-18}$-tallowalkyl-N,N-di-(2-hydroxyethyl)-N-amine oxide.

EXAMPLE II

A detergent composition was prepared having the following composition:

| INGREDIENTS | Composition A | Example II |
|---|---|---|
| Linear dodecylbenzene sulfonate sodium salt | 5.6 | 5.6 |
| Tallow alcohol sulfate sodium salt | 2.4 | 2.4 |
| Sodium tripolyphosphate | 24.0 | 24.0 |

-continued

| INGREDIENTS | Composition A | Example II |
|---|---|---|
| Sodium silicate solids ($SiO_2$:$Na_2O$ = 1.6) | 6.0 | 6.0 |
| Carboxymethylcellulose | 1.0 | 1.0 |
| Copolymer of maleic anhydride and methyl vinyl ether | 1.0 | 1.0 |
| Sodium sulfate | 18.2 | 17.85 |
| Moisture | 7.0 | 7.0 |
| $C_{12}$–$C_{14}$ alkyl dimethylamine oxide | — | 0.35 |
| Perborate tetrahydrate | 32.0 | 32.0 |
| Enzyme | 0.3 | 0.3 |
| Minors inclusive of perfume | 2.5 | 2.5 |

The amine oxide was incorporated into the crutcher. The spray-drying sensitive ingredients were added to the base-powder by dry-mixing.

Testing conditions were identical to those described in Example 1 hereinbefore.

Whiteness maintenance readings were pooled and averaged on 4 replicates with the following results. Swatches treated with composition A were used for reference purposes.

| Tracer | Example I |
|---|---|
| Terry | +1.00 |
| Undershirt | +0.80 |

EXAMPLE III

Detergent compositions were prepared by using the di-aminedioxide of Example I in accordance with the technique set forth in that example.

| Ingredients | Example I | Example III |
|---|---|---|
| Diamine-dioxide | 0.35 | 2.00 |
| Linear dodecylbenzene sulfonate sodium salt | 5.6 | 5.6 |
| Tallow alcohol sulfate sodium salt | 2.4 | 2.4 |
| Sodium tripolyphosphonate | 24.0 | 24.0 |
| Sodium silicate solids ($SiO_2$:$Na_2O$ = 1.6) | 6.0 | 6.0 |
| Carboxymethylcellulose | 1.0 | 1.0 |
| Copolymer of maleic anhydride and methyl vinyl ether | 1.0 | 1.0 |
| Perborate tetrahydrate | 32.0 | 32.0 |
| Enzyme | 0.3 | 0.3 |
| Minors inclusive of perfume | 2.5 | 2.5 |
| Sodium sulfate, moisture | | |

Testing conditions were identical to those described in Example I hereinbefore.

Whiteness maintenance leadings were pooled and averaged on 4 replicates with the following results. Swatches treated with Composition I were used for reference purposes.

| Tracer | Example III |
|---|---|
| Terry | −3.00 |
| Undershirt | −3.20 |
| Muslin | −2.00 |

These comparative results confirm the performance superiority and level criticality of a detergent composition containing the claimed amine-dioxides.

EXAMPLE IV

Liquid detergent compositions were prepared having the following compositions:

| Ingredients | Composition B | Example IV |
|---|---|---|
| Linear dodecylbenzene sulfonate sodium salt | 18.0 | 18.0 |
| Condensation product of 8 moles of ethylene oxide and one mole of a C12–C15 alcohol | 5.0 | 5.0 |
| Sodium citrate | 10.0 | 10.0 |
| Sodium silicate | 0.7 | 0.7 |
| Sodium xylene sulfonate | 5.5 | 5.5 |
| Carboxymethyl cellulose | 0.5 | 0.5 |
| N—hydrogenated tallow-N,N',N'—tri-(2-hydroxyethyl)-propylene diamine-1,3-N,N'—dioxide | — | 0.35 |
| Water | balance | balance |

The above compositions were used for comparative laundry tests in a Miele W421 washing machine.

Terry, undershirt, muslin and polyester cotton tracers were used to measure the comparative whiteness maintenance performance after 4 cumulative cycles in the way described in Example I.

Testing parameters were: 60° C. heat-up cycle; mainwash only step using a product concentration of 0.75% in city water with an average water hardness of about 3 mmoles/l.; ratio Ca/Mg: 5:1; laundering treatment in presence of 3 kg soiled clothes.

The whiteness maintenance readings were pooled and averaged on 4 replicates with the following results. The swatches treated with prior art composition B were used as a reference.

| Tracer | Example IV |
|---|---|
| Terry | +1.4 |
| Undershirt | +0.9 |
| Polycotton | +0.9 |

EXAMPLE V

A detergent composition was prepared having the composition of Example II, except for the $C_{12}$–$C_{14}$ dimethyl amine oxide which was used at a level of 0.5%, the balance being sodium sulfate.

The testing parameters were: 60° C. heat-up cycle; mainwash only using a product concentration of 0.7%; city water with an average water hardness of about 4.2 mmoles/l.; ratio Ca/Mg=5:1; laundering treatment in presence of 3 kg soiled clothes.

The whiteness maintenance readings were pooled and averaged on 4 replicates with the following results. The swatches treated with prior art composition A were used as a reference.

| Tracer | Example V |
|---|---|
| Terry | +1.8 |
| Undershirt | +1.4 |
| Muslin | +1.8 |
| Polycotton | +1.3 |

These data confirm that the compositions of this invention provide truly superior performance upon use in a up-to-60° C. (as compared to up-to-the-boil) laundering method.

Heavy duty liquid detergents are prepared by mixing the listed ingredients.

| Ingredients | Examples (% by Weight) VI | VII |
|---|---|---|
| Linear dodecylbenzene sulfonic acid | 14 | 17 |
| Condensate of 1 mole aliphatic C12–C15 alcohol with 7 moles of ethylene oxide | 15 | 15 |
| Lauric acid | 10 | 8 |
| Oleic acid | 5 | 7 |
| Triethanolamine | 5 | 6 |
| Sodium hydroxide | to adjust pH to 8 | |
| Propanediol-1,2 | 10 | 10 |
| Citric acid | 0.2 | 0.2 |
| Diethylene triamine penta methylene phosphonate | 0.6 | 0.6 |
| Silicone | 0.2 | 0.2 |
| Sodium formate | 1.0 | 1.0 |
| Proteolytic enzyme (Maxatase) | 0.2 | 0.2 |
| N—$C_{12-14}$-coconutalkyl-N,N—dimethyl N—amine oxide | 0.6 | — |
| N—tallow $C_{16-18}$alkyl-N,N',N'—tri-(2-hydroxyethyl)-propylene-1,3-diamine-N,N'—dioxide | — | 0.5 |
| Water + minors | balance to 100 | |

The compositions VI and VII of this invention exhibit excellent textile cleaning and whiteness maintenance properties.

I claim:

1. A particulate laundry detergent composition having enhanced soil release and cleaning properties comprising:

(a) from about 2% to about 25% by weight of a surface-active agent selected from the group consisting of anionic, nonionic, zwitterionic, and ampholytic detergents and mixtures thereof; and (b) from 0.25–0.75% of an amine oxide having the formula

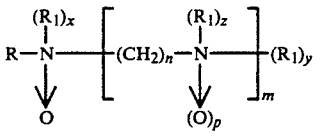

wherein R is an alkyl or alkenylgroup having 10 to 22 carbon atoms, the $R_1$'s which are identical or different are selected from $C_{1-4}$ alkyl, ethylene oxide and propylene oxide, n is an integer from 1 to about 6, m is an integer from 0 to about 6, p is 0 or 1, x, y, and z are each 1 for alkylsubstituents, and integers in the range from 1 to 10 for ethylene oxide or propylene oxide substituents such that the sum of (x+y+z) is not greater than 25, (c) from about 3% to about 50% by weight of a peroxybleach compound; and (d) from about 1% to about 50% by weight of a detergent builder;

whereby a 1% aqueous solution of the composition, measured at 20° C., has a pH in the range from about 8.5 to about 11.

2. The composition in accordance with claim 1 wherein the detergent builder is present in an amount from about 10% to about 45% by weight.

3. The detergent composition in accordance with claim 1 which in addition contains from 0.01% to 10% of a detergent suds regulant.

4. The detergent composition in accordance with claim 2 wherein the detergent builder is a mixture of (i) a water-soluble detergent builder selected from the group consisting of the water-soluble salts of nitrilotriacetic acid, polyphosphates and citrates; and (ii) a synthetic crystalline water-insoluble aluminosilicate builder material selected from the group consisting of zeolite A, zeolite X and zeolite P(B), said aluminosilicate material containing at least 10% by weight of the silicate of water of hydration and having a particle size diameter in the range from 0.5 micron to 30 microns;

whereby the weight ratio of the water-soluble detergent builder: water-insoluble aluminosilicate builder is in the range from about 4:1 to about 1:4.

5. The composition in accordance with claim 1, wherein the amine oxide is selected from the group consisting of N—$C_{12-14}$-coconutalkyl-N,N-dimethyl N-amine oxide; N-tallow $C_{16-18}$-alkyl-N,N',N-tri-(2-hydroxyethyl)-propylene-1,3-diamine-N,N'-dioxide; N—$C_{12-14}$-alkyl-N,N',N'-tri-(2-hydroxyethyl)propylene-1,3-diamine-N,N'-dioxide; N—$C_{16-18}$-tallow-alkyl-N,N-dimethyl-N-amine oxide; N—$C_{12-14}$-coconut alkyl-N,N-di-(2-hydroxyethyl)-N-amine oxide; or N—$C_{16-18}$-tallow-alkyl-N,N-di-(2-hydroxyethyl)-N-amine oxide.

6. The composition in accordance with claim 1 wherein m in the structural formula for the amine oxide is 1.

7. The composition in accordance with claim 6 wherein the amine oxide is N-hydrogenated tallow-N,N',N'-tri(2-hydroxyethyl)-propylene-1,3-diamine-N,N'-dioxide.

8. The composition in accordance with claim 1, wherein the amine oxide is present in an amount ranging from 0.25 to 0.35% by weight.

* * * * *